US005343904A

United States Patent [19]

Kaeser

[11] Patent Number: 5,343,904

[45] Date of Patent: Sep. 6, 1994

[54] AEROSOL CAN PRESSURIZING DEVICE AND AEROSOL CAN THEREFOR

[76] Inventor: Charles Kaeser, Route de St-Amour 22, CH - 1073 Savigny, Switzerland

[21] Appl. No.: 39,333

[22] PCT Filed: Sep. 9, 1992

[86] PCT No.: PCT/CH92/00185

§ 371 Date: Apr. 27, 1993

§ 102(e) Date: Apr. 27, 1993

[87] PCT Pub. No.: WO93/04928

PCT Pub. Date: Mar. 18, 1993

[30] Foreign Application Priority Data

Sep. 9, 1991 [FR] France ..... 91 11137

[51] Int. Cl.[5] ..... B65B 3/16; B67C 3/16

[52] U.S. Cl. ..... 141/20; 141/113; 141/346; 141/387; 141/269

[58] Field of Search ..... 141/3, 20, 117, 354, 141/357, 383, 387, 346

[56] References Cited

U.S. PATENT DOCUMENTS

| | | | |
|---|---|---|---|
| 3,027,922 | 4/1962 | Weston et al. | 141/20 |
| 3,592,244 | 7/1971 | Chamberlin | 141/3 X |
| 3,601,164 | 8/1971 | Bruce | 141/20 |
| 3,654,743 | 4/1972 | McGeary . | |
| 3,748,818 | 7/1973 | Rousseau . | |
| 4,197,884 | 4/1980 | Maran | 141/383 |
| 4,716,946 | 1/1988 | Grigoletto | 141/746 X |
| 4,877,065 | 10/1989 | Lamboy et al. | 141/113 X |
| 5,092,750 | 3/1992 | Leroy et al. | 141/20 X |

FOREIGN PATENT DOCUMENTS

| | | | |
|---|---|---|---|
| 2901569 | 7/1980 | Fed. Rep. of Germany . | |
| 8808407.8 | 10/1988 | Fed. Rep. of Germany . | |
| 3800194 | 7/1989 | Fed. Rep. of Germany . | |
| 9200239 | 1/1992 | PCT Int'l Appl. | 141/57 |
| 847578 | 9/1960 | United Kingdom . | |
| 1248665 | 7/1973 | United Kingdom . | |

*Primary Examiner*—Ernest G. Cusick

*Attorney, Agent, or Firm*—Davis, Bujold & Streck

[57] ABSTRACT

A device for pressurizing an aerosol can (11) in order to refill it with propellant gas (10) comprises a housing (12) containing an air compressor (14) which consists of a cylinder (15), a driving motor (16) and a plunger, a filling nozzle (18) for injecting pressurized air into the aerosol can, a mechanism for activating said compressor when a can is fitted to the filling nozzle, and a mechanism for deactivating said compressor when the air injected into the can reaches a predetermined pressure. A coupling member is provided for coupling the device and the aerosol can when the latter is positioned in a seating (17).

11 Claims, 2 Drawing Sheets

FIG. 1
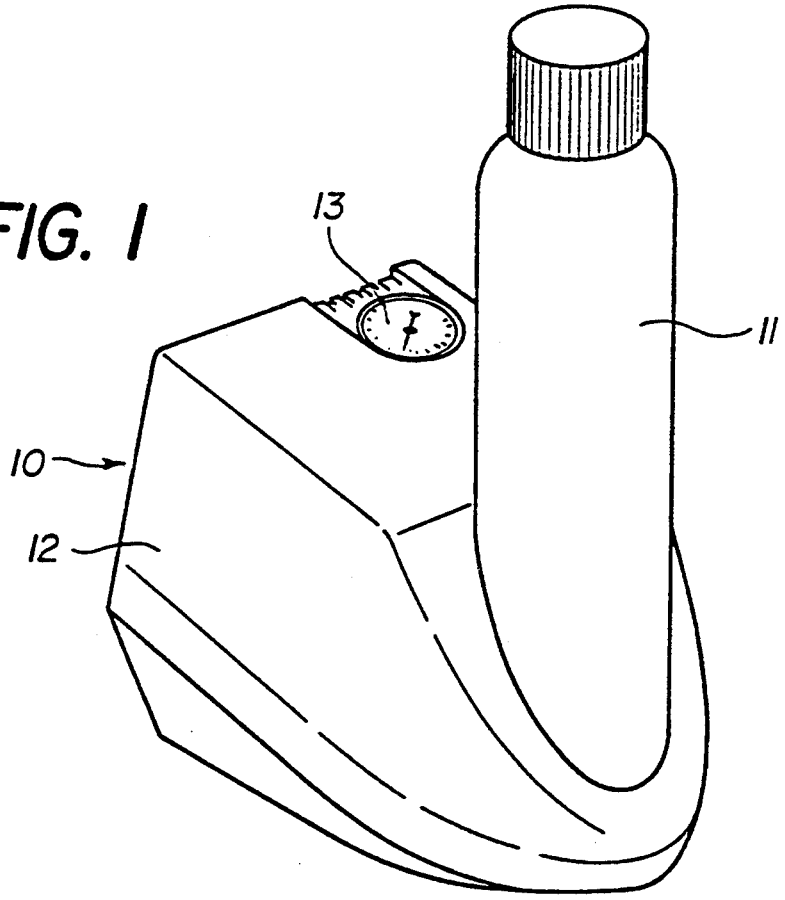
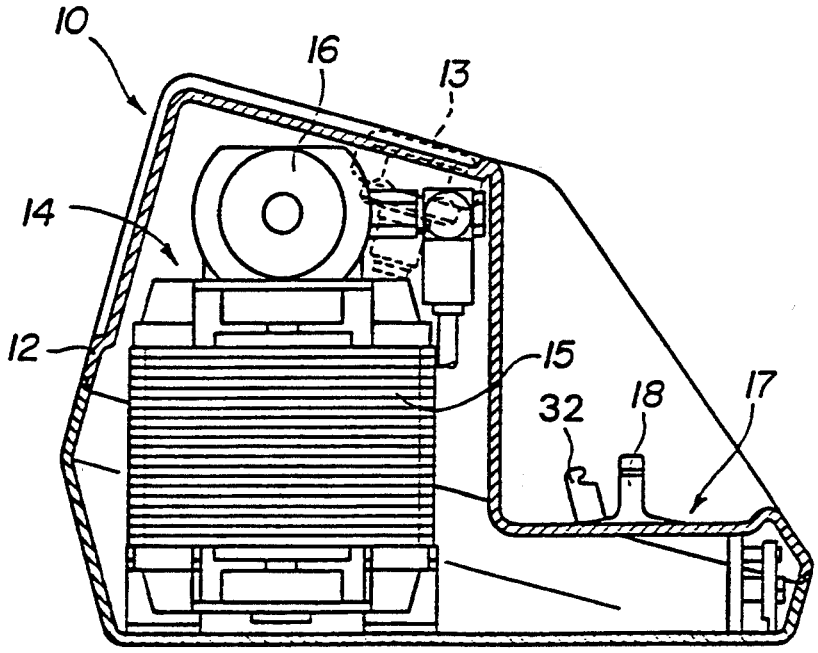
FIG. 2

AEROSOL CAN PRESSURIZING DEVICE AND AEROSOL CAN THEREFOR

FIELD OF THE INVENTION

The present invention concerns a device for pressurizing an aerosol can with a flow control valve, said device comprising a housing with a holder for the aerosol can and having an electric pump which comprises the air compressor, means for starting and stopping the air compressor, and connection means for temporarily attaching the aerosol can to the compressor.

It further concerns an aerosol can adapted to the pressurizing device consisting of an enclosed area holding said aerosol and some air, said enclosed area having a spray device at the upper portion and a base designed to hold the fill nozzle of the pressurizing device, said base being provided with a flow control conduit preventing the pressurized air in said can from escaping.

BACKGROUND OF THE INVENTION

The problem of aerosols and gas propellants causing harm to the ozone layer has been widely debated in science and industry and many attempts have been made to find effective, economical alternatives.

The propellant gas which causes no atmospheric pollution and which would therefore provide the ideal solution, namely, air, cannot be maintained under sufficient pressure in an aerosol can during storage and use. Thus, other solutions have been proposed which resolve the user's immediate problems, but are far less satisfactory from the point of view of economics and ecology. The problem to be overcome is that of maintaining a reserve of pressure in a can which is sufficient to allow the entire can contents to be sprayed out and used. Propellant gases presently in use are methane, propane, etc. These gases are flammable or even explosive when mixed with a certain proportion of air and can therefore be dangerous to use.

Furthermore, from an economic point of view, such use wastes energy, since it is certainly preferable to utilize these combustible gases as energy sources rather than as propellants freed into the atmosphere. Finally, these gases generally cannot be mixed with the can contents and must be sealed into flexible pouches made of aluminum, synthetic material or a very thin film of composite material.

A more satisfactory solution is to recharge the aerosol can with compressed air when pressure in the can is no longer adequate to propel the substance from the can.

Various devices are known for pressurizing aerosol cans, specifically in German Publication No. DE-A-3 800 194 and Utility Model DE-U-8 808 407.

German Publication DE-A-3 800 194 describes an aerosol can pressurizing device using a compressor consisting of a fill nozzle and a switch. The problem with this device is that it provides neither a means for attaching it to the aerosol can nor a means for controlling pressure inside the can. The user must hold the can in place manually by pressing it downward to engage the fill nozzle with the flow control valve on the aerosol can and thus keep the valve open during the filling process. The user must then remove the aerosol can when he or she estimates that there is adequate interior pressure in the can to spray out the contents, that is, neither too high nor too low, which can be dangerous.

The device described in Utility Model DE-U-8 808 407 consists of a frame with a compressor which has a reservoir of compressed air, a fill nozzle and an upper arm. When the aerosol can is engaged with the housing provided in the frame, the upper arm presses the can downward. This causes the flow control valve located in the can base and engaging the fill nozzle to open, which places the compressed air reservoir in contact with the inside of the can. Pressure in the air reservoir and inside the can reach an equilibrium. This can has several flaws. It is particularly large and therefore impractical. In addition, because of the fact that it has an upper arm and the way this functions, only cans of a certain height can be used. Another problem with this device arises because the inside of the can remains in contact with the reservoir of compressed air as long as the can remains on the support. Here again, the user must remove the can from the support when he or she estimates that the desired interior pressure has been attained.

In sum, these present solutions are dangerous, expensive, polluting and impractical, and thus wholly unsatisfactory.

SUMMARY OF THE INVENTION

The present invention proposes overcoming these disadvantages by providing an aerosol can pressurizing device and cans adapted thereto which are effective, economical, practical and which completely eliminate the pollution problems caused by propellant gases.

To achieve this, the device according to the invention is characterized in that the connection means are designed to cooperate with the compressor's on/off means and to activate the compressor the moment the aerosol can is positioned in the housing and then turn it off the moment the interior air pressure in the can reaches a predetermined level.

According to an advantageous embodiment, said connection means consists of a locking device which maintains the aerosol can in the housing until the moment the predetermined pressure level is reached.

Said locking means preferably consists of a lever with means for attaching it to the aerosol can.

Said lever is preferably located in an inclined groove formed in the can, which also contains a spring tending to force said lever into a first upper position defined by a stop which limits its displacement.

In this embodiment, the lever has a click stop notch on its lateral surface, said notch being designed to cooperate with a click stop on-said lever in a second lowered position when the spring is compressed.

The click stop may be connected to a piston, one surface of which is subjected to the influence of an equalizing spring and the other surface of which is subjected to the pressurized air contained in the aerosol can.

Said piston is advantageously housed in an opening formed in the can and divides the opening into two chambers, one of which contains the equalizing spring and the other of which communicates with the aerosol can through the fill nozzle.

In this preferred form of embodiment, the chamber holding the equalizing spring has an axial groove designed to allow the pressurized gas to escape freely when the piston surpasses a predetermined point.

According to another embodiment the lever comprises means for cooperating with a switch activating and deactivating the compressor so that the compressor is on when the lever is in a second position and off when the lever is in the first position.

For the same reason, the aerosol can is characterized in that its base has attachment means designed to cooperate with said attachment means on said pivoting lever of the connection means.

Preferably, said base comprises an annular groove designed to cooperate with said attachment means on the pivoting lever of the connection means.

According to a preferred embodiment, said base is locked in a central opening in the enclosed area, with the portion having the flow control valve being located inside the enclosed area and the portion comprising said groove being located outside said enclosed area.

BRIEF DESCRIPTION OF THE DRAWINGS

The present invention will be better understood with reference to the description of one preferred embodiment and to the attached drawings, in which:

FIG. 1 is a perspective of the aerosol can pressurizing device according to the invention;

FIG. 2 is an axial cross-section of the device according to FIG. 1 with the aerosol can removed;

DESCRIPTION OF THE PREFERRED EMBODIMENTS

Figure 3:
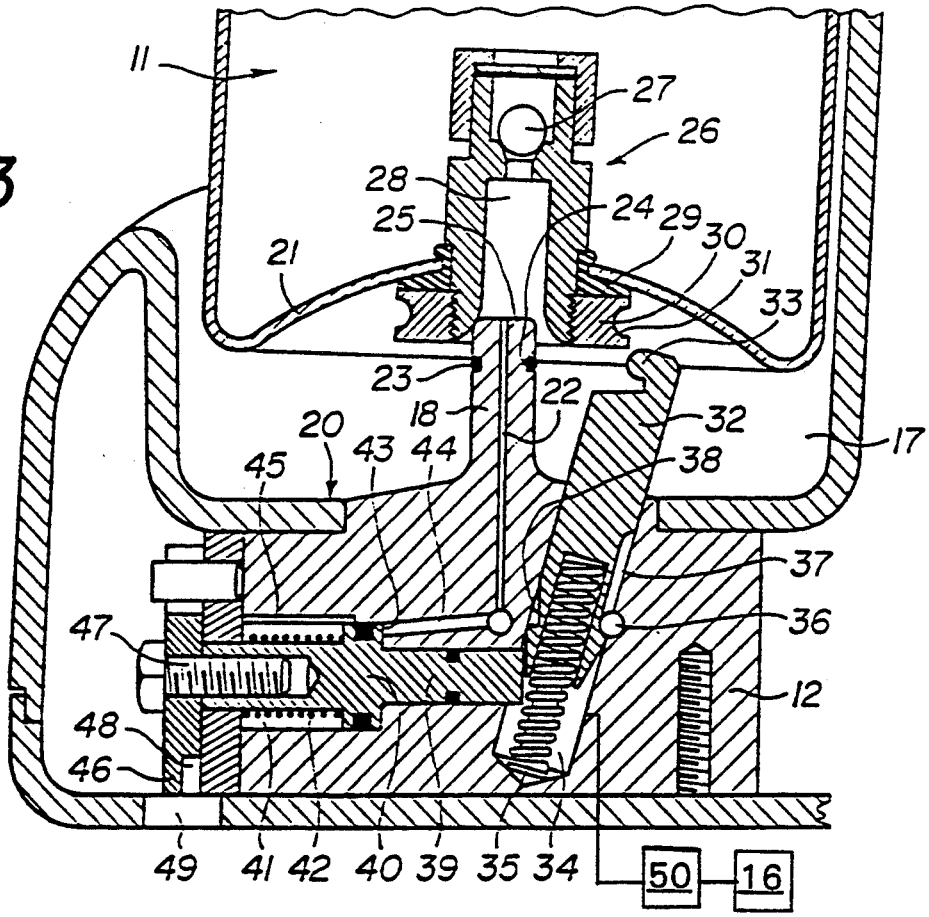
FIG. 3 is a partial view of the aerosol can pressurizing device at the time the can is positioned on the device.

With reference to the drawings, device 10 for pressurizing an aerosol can 11 consists principally of a housing 12 with a gauge 13 on its top surface for indicating the pressure level of the compressed air injected into can 11 by device 10. The general configuration of the aerosol can is conventional but, as will be explained in greater detail below, the base has a means through which compressed air can be injected. This can be accomplished in different ways.

As shown more specifically in FIG. 2, housing 12 contains an electric pump comprising the air compressor 14 consisting of a cylinder 15 and a drive motor 16, as well as at least one compression piston. Such compressors are known in the industry and are presently used for various applications such as, for example, inflating automobile tires, inflatable swimming floats, air mattresses, inflatable boats, etc., and are supplied with electricity through a special adapter connected to a car cigarette lighter. Naturally, any other miniature compressor could be used as the source of compressed air so long as the compressor is able to supply air compressed to at least 8 bars.

Housing 12 consists of a seating 17 designed to receive the rear extremity of the aerosol can. In order for the compressed air generated by compressor 14 to be injected into the aerosol can, the pressurizing device 10 has a fill nozzle 18. A connection means in the form of a lever 32 is provided in order to attach the pressurizing device to the aerosol can positioned on seating 17.

Figure 4:
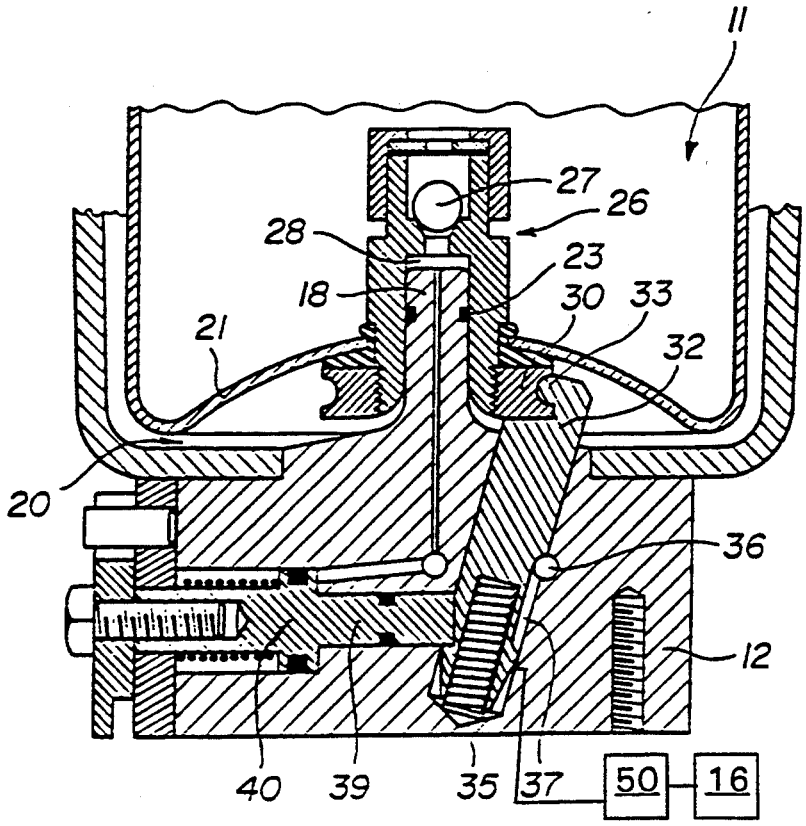
FIG. 4 is a view similar to that of FIG. 3 when the aerosol can is positioned on the pressurizing device in order to be filled with compressed air.

FIGS. 3 and 4 show a first embodiment of the connection means associated with the fill nozzle and with the aerosol can. Seating 17 defines a circular platform 20 with a slightly larger diameter than base 21 of aerosol can 11. Fill nozzle 18 is located at the center of platform 20 and consists of a generally cylindrical piece traversed by an axial conduit 22, and the peripheral surface of the nozzle has a seal 23 in annular groove 24. The function of conduit 22 is to direct the compressed air generated by the compressor toward the distal end 25 of nozzle 18, and finally to an enclosed area defined inside aerosol can 11.

To achieve this, the bottom of the can has a base 26 provided with a ball-bearing valve or other suitable flow control valve and with an opening 28 which corresponds in size and shape to nozzle 18 so that the nozzle can seal tightly inside said opening 28. This base, which is generally cylindrical, engages in a suitable central opening formed in the bottom 21 of the aerosol can, and is attached to it by a locking ring 29. An annular portion 30 comprising an annular groove 31 is attached to the exterior portion of base 26 and, together with lever 32 which is integral with the housing of the pressurizing device, ensures the connection between said device and the corresponding aerosol can. Said lever 32 has a point 33 on its upper extremity designed to engage with annular groove 31 and to form therewith a means for attaching lever 32 and annular portion 30, that is, to ensure the connection between the aerosol can and the device for pressurizing the can.

Lever 32 is located in a slanted groove 34 formed in housing 12 which contains a pressure spring 35 tending to push said lever into the upper position shown in FIG. 3. A stop consisting of a peg 36, in cooperation with a longitudinal groove 37, limits lever displacement to two positions, a first upper position shown in FIG. 3 and a second lowered position shown in FIG. 4. The lever further comprises a click stop notch 38 formed on its lateral surface, said notch being designed to cooperate with a click stop 39 connected to a piston 40 housed in an opening. Said piston 40 defines a chamber 41 in which there is an equalizing spring 42 and a second chamber 43 which communicates via conduit 44 with compressed air inlet conduit 22 formed in nozzle 18.

When aerosol can 11 is placed in position on nozzle 18, lever 32 is pushed into its lowered position. Point 33 of the lever engages in annular groove 31. When it has assumed the lowered position, click stop 39 engages in cooperating notch 38, thereby preventing lever 32 from moving upward under the influence of spring 35. In this lowered position, a switch 50 controlling the compressor is automatically activated, which activates production of compressed air injected through nozzle 18, base 26 and ball-bearing valve 27 into the enclosed area formed in aerosol can 11. Equalizing spring 42 is set at a predetermined tension so that piston 40 is subjected to two equalized forces when the pressure of the compressed air reaches approximately 8 bars. At this point the compressed air injected into the enclosed area in the aerosol can is also at that pressure. When the pressure level of the compressed air increases and exceeds a predetermined threshold, piston 40 is pushed in the direction opposite to the direction in which equalizing spring 42 tends to push it. Click stop 39 disengages from cooperating notch 38, thereby freeing lever 32. Under the influence of pressure spring 35, the lever rises and resumes its upper position, while at the same time pushing against the aerosol can and deactivating the compressor start-up switch 50. Ball-bearing conduit 27 closes due to the effect of the pressure inside the aerosol can, which traps the air within the can.

In case the aerosol can is stuck in the fill position because the locking mechanism, or specifically lever 32, will not release, a safeguard is provided to prevent a dangerous build-up of excess pressure in the can. For this purpose, an axial groove 45 is formed in chamber 41 so air can escape freely if piston 40 moves back beyond a certain predetermined point. This safeguard is also operative if, for whatever reason, the compressor does not shut off when maximum pressure has been attained.

To prevent the can from being blocked if there is a power interruption during the filling process, piston 40 is connected to a small plate 46 by a screw 47. Plate 46 has a notch 48 opposite an access opening 49 formed in the base of the can. In case the electricity supply fails or the motor malfunctions, the user can therefore push plate 46 back manually with an appropriate tool such as a screwdriver, thereby causing the piston and the click step to retract, which frees lever 32 and disengages the aerosol can.

This embodiment provides the advantage of using compressed air as a propellant gas for substances to be sprayed in aerosol form. For this reason, the ecological and economic problems discussed previously are simply and effectively overcome.

I claim:

1. An aerosol can for use with a device for pressurizing said aerosol can, said device comprising a housing (12) including an air compressor, for supplying pressurized air, and a seat (17) for supporting an aerosol can; a mechanism for activating and deactivating said air compressor; and a mechanism for releasably coupling said aerosol can with said air compressor so that said air compressor supplies pressurized air to said aerosol can, said mechanism for releasably coupling said aerosol can with said air compressor cooperating with said mechanism for activating and deactivating said air compressor to activate said air compressor when said aerosol can is positioned on said seat (17), and to deactivate said air compressor when air pressure inside said aerosol can (11) reaches a predetermined pressure level, and said mechanism for releasably coupling said aerosol can with said air compressor including a lever mechanism (32), engagable with said aerosol can, for maintaining said aerosol can properly positioned on said seat (17) until such time as the air pressure inside said aerosol can reaches the predetermined pressure level;

said aerosol can comprising an enclosed area for containing an aerosol and air, a spray device communicating with said enclosed area for allowing selective discharge of aerosol and air contained with said aerosol can, a base having means for engaging a filling nozzle supported by said seat, and said base having a fluid control valve for controlling the flow of pressurized air into said aerosol can;

wherein said base (26) comprises an attachment surface which cooperates with said lever mechanism (32).

2. The aerosol can according to claim 1, wherein said attachment surface comprises an annular groove (31).

3. The aerosol can according to claim 2, wherein said base is attached to a central opening of said enclosed area so that the portion of said base which supports said fluid control valve is located inside said enclosed area and the portion which comprises said annular groove is located outside said enclosed area.

4. A device for pressurizing, with pressurized air, an aerosol can having a flow control valve, said device comprising:

a housing (12) comprising an air compressor, for supplying pressurized air, and a seat (17) for supporting an aerosol can;

means for activation of and deactivation of said air compressor; and means for releasably coupling said aerosol can with said air compressor so that said air compressor supplies pressurized air to said aerosol can, said means for releasably coupling said aerosol can with said air compressor cooperating with said activation and deactivation means for activating said air compressor when said aerosol can is positioned on said seat (17), and deactivating said air compressor when air pressure inside said aerosol can (11) reaches a predetermined pressure level, and said means for releasably coupling said aerosol can with said air compressor including a lever mechanism (32), engagable with said aerosol can, for maintaining said aerosol can properly positioned on said seat (17) until such time as the air pressure inside said aerosol can reaches the predetermined pressure level;

wherein said lever mechanism (32) is at least partially housed within an inclined groove (34) located within said housing, and said inclined groove contains a pressure spring (35) biasing said lever mechanism toward an extend first position in which a stop member (36) limits displacement of said lever mechanism.

5. The device according to claim 4, wherein said lever mechanism has a first click stop member (38) formed in a lateral surface thereof, said first click stop member cooperates with a second mating click stop member (39) so as to lock said lever mechanism in a retracted second position in which said pressure spring (35) is compressed.

6. The device according to claim 5, wherein said second click stop member (39) is connected to a piston (40) having two opposed surfaces, one of said two opposed surfaces engages an equalizing spring (42) and the other of said two opposed surfaces communicates with pressurized air contained within said aerosol can.

7. The device according to claim 6, wherein said piston (40) is located within an opening formed is said housing, said piston (40) divides said opening into first and second chambers (41, 43), and said first chamber contains said equalizing spring (42) and said second chamber (43) communicates with an interior of said aerosol can via a conduit.

8. The device according to claim 7, wherein said first chamber has an axial groove (45) formed therein which allows excess pressurized air, supplied by said air compressor, to escape freely once said piston is displaced a predetermined distance.

9. The device according to claim 4, wherein said seat includes a nozzle coupled with said air compressor via a conduit for supplying pressurized air from said air compressor to said aerosol can.

10. The device according to claim 9, wherein said nozzle is located in a central portion of the seat and has at least one annular groove which accommodates a seal to prevent escape of pressurized air once said nozzle properly engages with a base portion of said aerosol can.

11. A device for pressurizing, with pressurized air, an aerosol can having a flow control valve, said device comprising:

a housing (12) comprising an air compressor, for supplying pressurized air, and a seat (17) for supporting an aerosol can;

means for activation of and deactivation of said air compressor; and means for releasably coupling said aerosol can with said air compressor so that said air compressor supplies pressurized air to said aerosol can, said means for releasably coupling said aerosol can with said air compressor cooperating with said activation and deactivation means for activating said air compressor when said aerosol can is positioned on said seat (17), and deactivating said air compressor when air pressure inside said aerosol can (11) reaches a predetermined pressure level, and said means for releasably coupling said aerosol can with said air compressor including a lever mechanism (32), engagable with said aerosol can, for maintaining said aerosol can properly positioned on said seat (17) until such time as the air pressure inside said aerosol can reaches the predetermined pressure level;

wherein said lever mechanism is movable and cooperates, when said lever mechanism is in a second position, with a switch which activates said air compressor to supply pressurized air to said aerosol can and, when said lever mechanism is in a first position, said switch deactivates said air compressor.

* * * * *